US009410784B1

(12) United States Patent
Nance et al.

(10) Patent No.: US 9,410,784 B1
(45) **Date of Patent: *Aug. 9, 2016**

(54) INITIATOR ASSEMBLY WITH GAS AND/OR FRAGMENT CONTAINMENT CAPABILITIES

(71) Applicant: Reynolds Systems, Inc., Middletown, CA (US)

(72) Inventors: Christopher J. Nance, Middletown, CA (US); Michael Amendola, Kelseyville, CA (US)

(73) Assignee: Reynolds Systems, Inc., Middletown, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/686,862

(22) Filed: Apr. 15, 2015

Related U.S. Application Data

(63) Continuation of application No. 13/779,057, filed on Feb. 27, 2013, now Pat. No. 9,038,538.

(60) Provisional application No. 61/604,255, filed on Feb. 28, 2012.

(51) Int. Cl.

| | |
|---|---|
| ***F42C 19/02*** | (2006.01) |
| ***F42C 19/12*** | (2006.01) |
| ***F42B 3/10*** | (2006.01) |
| ***F42B 3/12*** | (2006.01) |
| ***F42B 3/18*** | (2006.01) |
| ***F42B 3/185*** | (2006.01) |

(52) U.S. Cl.
CPC . *F42C 19/12* (2013.01); *F42B 3/10* (2013.01); *F42B 3/12* (2013.01); *F42B 3/125* (2013.01); *F42B 3/18* (2013.01); *F42B 3/185* (2013.01); *F42C 19/02* (2013.01)

(58) Field of Classification Search
CPC ..... F42B 3/10; F42B 3/103; F42B 3/12; F42B 3/125; F42B 3/127; F42B 3/13; F42B 3/18; F42B 3/185; F42C 19/12; F42C 19/0819; F42C 19/02; F42C 19/08; F02K 9/95
USPC ..... 102/202.1, 202.2, 202.5, 202.7, 202.8, 102/202.9, 202.11, 202.12, 202.14, 530, 102/531
See application file for complete search history.

(56) References Cited

U.S. PATENT DOCUMENTS

| | | | | | |
|---|---|---|---|---|---|
| 4,316,412 | A * | 2/1982 | Dinegar | F42B 3/103 | 102/202.5 |
| 4,592,280 | A * | 6/1986 | Shores | F42B 3/188 | 102/202.14 |
| 5,291,828 | A * | 3/1994 | Nerheim | F42C 19/08 | 102/202 |
| 5,293,821 | A * | 3/1994 | True | F42B 3/16 | 102/275.12 |
| 5,345,872 | A * | 9/1994 | Takahashi | F42B 3/18 | 102/202.14 |
| 5,602,359 | A * | 2/1997 | Hambro | F42B 3/103 | 102/202.14 |
| 6,418,853 | B1 * | 7/2002 | Duguet | F42B 3/121 | 102/202.2 |
| 7,430,963 | B2 * | 10/2008 | Hennings | F42B 3/103 | 102/202.1 |

(Continued)

*Primary Examiner* — James S Bergin
(74) *Attorney, Agent, or Firm* — Harness, Dickey & Pierce, P.L.C.

(57) ABSTRACT

An initiator assembly that includes an initiator and a containment shell. The initiator has an initiator housing, an initiator device mounted inside the initiator housing, and an input charge that is formed of an energetic material. The initiator device is configured to initiate at least one of a combustion event, a deflagration event and a detonation event in the input charge. The containment shell is coupled to the initiator housing and defines a space into which gas and/or particles are ejected from the initiator housing if the initiator device is not activated and the input charge is cooked off.

22 Claims, 6 Drawing Sheets

(56) References Cited

U.S. PATENT DOCUMENTS

| | | | | |
|---|---|---|---|---|
| 7,516,701 | B2 * | 4/2009 | Kurita | B60R 21/26 102/530 |
| 7,571,679 | B2 | 8/2009 | Nance | |
| 7,661,362 | B2 * | 2/2010 | Hennings | F42B 3/103 102/202.1 |
| 7,762,195 | B2 | 7/2010 | Friedlander, III et al. | |
| 7,866,264 | B2 | 1/2011 | Nance | |
| 8,006,622 | B2 * | 8/2011 | Munoz Saldarriaga | F42B 39/14 102/314 |
| 8,113,117 | B2 | 2/2012 | Nance | |
| 8,408,131 | B1 | 4/2013 | Nance | |
| 8,726,808 | B1 | 5/2014 | Nance | |
| 2002/0178956 | A1 * | 12/2002 | Mattes | F42B 3/13 102/202.12 |

* cited by examiner

INITIATOR ASSEMBLY WITH GAS AND/OR FRAGMENT CONTAINMENT CAPABILITIES

CROSS REFERENCE TO RELATED APPLICATIONS

This application is a continuation of U.S. patent application Ser. No. 13/779,057 filed Feb. 27, 2013, which claims the benefit of U.S. Provisional Patent Application Ser. No. 61/604,255 filed Feb. 28, 2012 entitled "Initiator Assembly With Gas And/Or Fragment Containment Capabilities". The disclosure of the above-referenced patent applications are incorporated by reference as if set forth in their entirety herein.

FIELD

The present disclosure relates to an initiator assembly having gas and/or fragment containment capabilities.

BACKGROUND

This section provides background information related to the present disclosure which is not necessarily prior art.

Certain initiators for energetic materials must meet the MIL-DTL-23659 standard, which requires that the initiator assembly be exposed to a relatively large amount of electrical power (i.e., 20 amps @ 440 VAC) for an extended period of time (i.e., 5 minutes) without causing initiation of the initiator assembly's output charge. Exposure of the initiator assembly to such large amounts of electrical power can cause the initiator assembly's input charge, typically formed of a secondary explosive, to "cook off". The standard requires that the initiator assembly be constructed such that cook-off of the input charge not cause subsequent energetic initiation (i.e., combustion, deflagration, detonation) of the initiator assembly's output charge. Heretofore, the initiator assemblies that we know of that are compatible with the MIL-DTL-23659 standard must have an external vent that permits gases generated by the input charge as it cooks-off (and fragments of the initiator assembly) to be vented from the interior of the initiator assembly.

It can be desirable at times to position an initiator assembly within the propellant of a motor (e.g., rocket). For such initiators to also comply with the MIL-DTL-23659 standard, the initiator assembly cannot leak or eject materials or energy that might possibly initiate the motor propellant. Additionally, such an initiator assembly is preferably relatively small, produces a consistent output, and should not generate casing fragments or solid by-product that could impede proper function of the motor valves.

Accordingly, there remains a need in the art for an improved initiator assembly that is suited for use in the propellant of a motor.

SUMMARY

This section provides a general summary of the disclosure, and is not a comprehensive disclosure of its full scope or all of its features.

In one form, the present teachings provide an initiator assembly that includes an initiator and a containment shell. The initiator has an initiator housing, an initiator device mounted inside the initiator housing, and an input charge that is formed of an energetic material. The initiator device is configured to initiate at least one of a combustion event, a deflagration event and a detonation event in the input charge.

The containment shell is coupled to the initiator housing and defines a space into which gas and/or particles are ejected from the initiator housing if the initiator device is not activated and the input charge is cooked off. The containment shell is configured such that the gas and/or the fragments produced when the input charge is cooked off is/are contained within the initiator assembly.

In another form, the present teachings provide an initiator assembly that includes an initiator and a containment shell. The initiator has an initiator housing, an initiator device mounted inside the initiator housing, and an input charge that is formed of an energetic material. The initiator device is configured to initiate at least one of a combustion event, a deflagration event and a detonation event in the input charge. The containment shell is coupled to the initiator housing and defines a space into which gas and/or particles are ejected from the initiator housing if the initiator device is not activated and the input charge is cooked off. The space is sized such that the gas and/or the fragments produced when the input charge is cooked off is/are contained within the initiator assembly.

In still another form, the present teachings provide an initiator assembly with an initiator and a containment shell. The initiator has an input charge that is formed of an energetic material and is configured to initiate a detonation event in the input charge. The containment shell is coupled to the initiator housing and defines a space into which gas and/or particles are ejected from the initiator housing if the initiator device is not activated and the input charge is cooked off. The containment shell is configured such that the gas and/or the fragments produced when the input charge is cooked off is/are contained within the initiator assembly.

In yet another form, the present teachings provide an initiator assembly with an initiator and a containment shell. The initiator has an input charge that is formed of an energetic material and is configured to initiate a detonation event in the input charge. The containment shell is coupled to the initiator housing and defines a space into which gas and/or particles are ejected from the initiator housing if the initiator device is not activated and the input charge is cooked off. The space is sized such that the gas and/or the fragments produced when the input charge is cooked off is/are contained within the initiator assembly.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
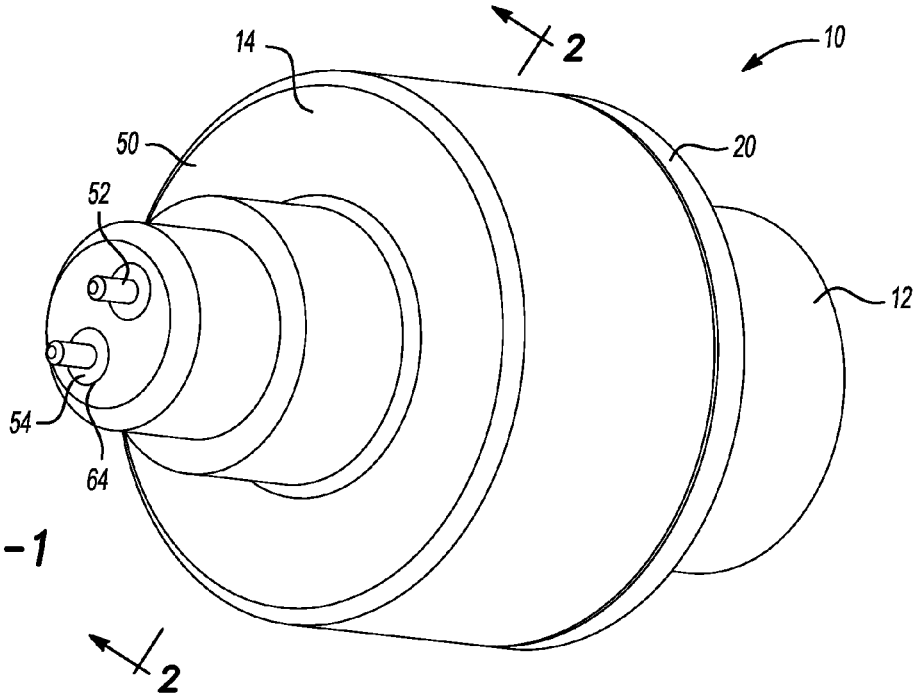
FIG. 1 is a perspective view of an initiator assembly constructed in accordance with the teachings of the present disclosure.
Figure 2:
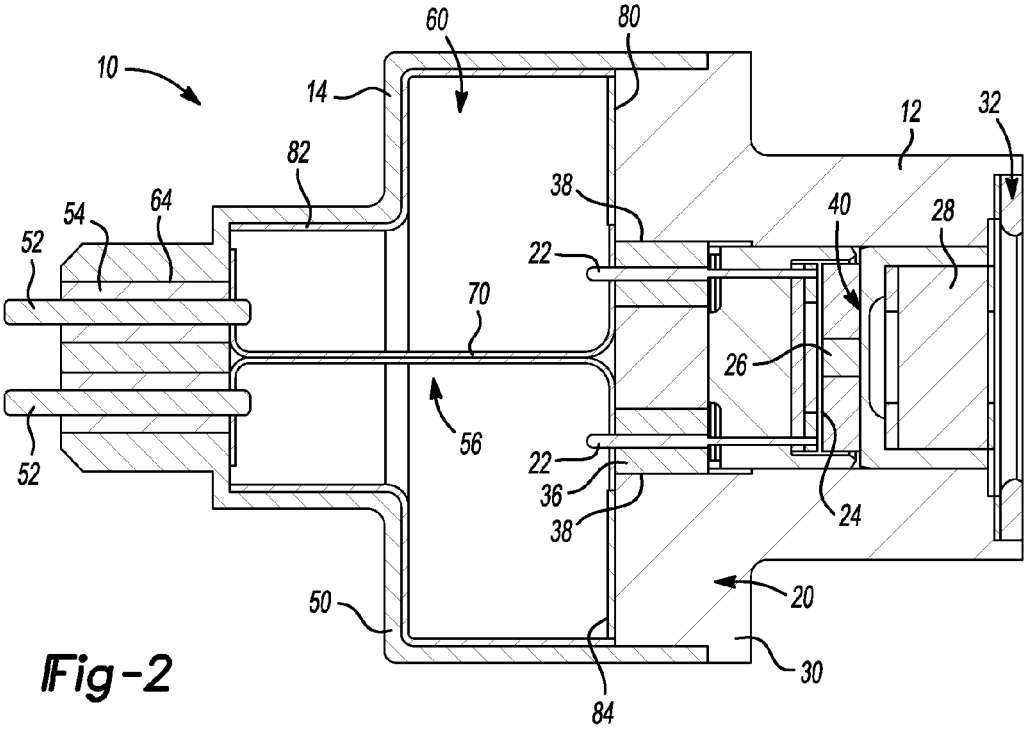
FIG. 2 is a longitudinal section view of the initiator assembly of FIG. 1.

With reference to FIGS. 1 and 2 of the drawings, an initiator assembly constructed in accordance with the teachings of the present disclosure is generally indicated by reference numeral 10. The initiator assembly 10 can include an initiator 12 and a containment structure 14.

The initiator 12 can generally include an initiator housing 20, a plurality of first terminals 22, an initiator device 24, an input charge 26 and an output charge 28 and can be constructed in a manner that satisfies the MIL-DTL-23659 standard. One exemplary configuration for the initiator 12 is disclosed in U.S. Pat. No. 7,661,362, the disclosure of which is incorporated by reference as if fully set forth in detail herein.

Briefly, the initiator housing 20 can comprise a housing body 30 and a cover assembly 32. The housing body 30 can be formed of any desired material, such as 304L stainless steel, Inconel or KOVAR®, for example. The cover assembly 32 can be welded to the housing body 30 to hermetically seal a space into which the initiator device 24, the input charge 26 and the output charge 28 can be received. The first terminals 22 can be received in one or more seals (e.g., first seals 36) that in turn can be received in holes 38 in the housing body 30. The first seals 36 can be formed of any suitable material, such as glass, and can sealingly engage the first terminals 22 and the housing body 30.

The initiator device 24 can be any kind of device that is configured to initiate an energetic material, such as a secondary explosive, such as RSI-007 which is available from Reynolds Systems, Incorporated of Middletown Calif. Exemplary initiator devices can comprise an exploding foil initiator, an exploding bridgewire initiator, semi-conductor bridge devices, squibs, and thin-film initiators. In the particular example provided, the initiator device 24 comprises an exploding foil initiator, which may conventionally include a pair of initiator contacts (not specifically shown), which are electrically coupled to respective ones of the first terminals 22, a bridge (not specifically shown), which is disposed between the initiator contacts, a barrel (not specifically shown), which is mounted over the bridge, and a flyer that may be expelled from the barrel when the initiator device 24 is activated due to conversion of the material that forms the bridge into a plasma. As those of skill in the art will appreciate, the flyer can impact against the input charge 26 to initiate the input charge 26 such that the input charge 26 releases energy in a desired manner.

In the particular example provided, initiator assembly 10 is configured to produce a pyrotechnic output that would be suitable for initiating combustion in the fuel of a rocket motor. The initiator device 24 can be configured to detonate the input charge 26 and energy released from the detonation of the input charge 26 can be employed to initiate combustion or deflagration of the output charge 28, which can be formed of BKNO3. As those of skill in the art will appreciate, energy released during detonation of the input charge 26 can be attenuated by a barrier system 40 as is disclosed in detail in U.S. Pat. No. 7,661,362.

The containment structure 14 can comprise a containment shell 50, a plurality of second terminals 52, a plurality of second seals 54 and a connector circuit 56.

The containment shell 50 can be formed of any appropriate material, such as 304L stainless steel, Inconel, or KOVAR®, for example, and can be shaped in any desired manner that may be suited to reduce the cost of the manufacture of the initiator assembly 10 and/or to facilitate packaging of the initiator assembly 10 into a device (e.g., a rocket motor). The containment shell 50 can be fixedly coupled to the initiator housing 20 and can define a void space 60 into which the first terminals 22, the second terminals 52 and the connector circuit 56 can extend. The second terminals can be received in one or more of the second seals 54, which can be received in a corresponding hole or holes 64 in the containment shell 50, and the second seals 54 can sealingly engage the second terminals 52 and the containment shell 50. The second seals 54 may be formed of any desired material, such as glass. If desired, the second terminals 52 can be configured such that the portion that extends through the second seals 54 into the void space 60 can be configured to buckle in the event that an axial load is applied to the second terminals 52 that would otherwise tend to urge the second terminals 52 in a direction away from the initiator 12. One manner to promote the buckling of the second terminals 52 is to form a portion of the second terminals 52 that extends into the void space 60 such that the portion (in part or in its entirety) has a cross-sectional size (e.g., diameter) that is smaller than a portion that is located in a corresponding one of the second seals 54.

The connector circuit 56 can be configured to electrically couple the first and second terminals 22 and 52 to one another and as such, any suitable electric conductors can be employed. In the particular example provided, the connector circuit 56 comprises a low-inductance flex circuit 70 that is soldered to the first and second terminals 22 and 52. As used herein, the term "low-inductance" means an inductance of less than 250 nano-Henries (nH), preferably less than or equal to 50 nH and more preferably less than or equal to 30 nH. The inductance can be measured when power that is configured to cause the initiator 12 to operate is transmitted through the connector circuit 56. In the particular example provided, the containment structure 14 (including the flex circuit 70) adds an inductance of about 15 to 25 nano-Henries to the inductance of the initiator 12. As will be appreciated, the flex circuit 70 can be a flexible flat cable (FFC), a ribbon cable, or a flexible plastic substrate (e.g., polyimide, polyester ether ketone (PEEK)) having one or more conductive elements coupled thereto. In the particular example provided, the flex circuit 70 comprises a flexible plastic substrate onto which a conductive foil is deposited or adhered. The conductive foil can be etched to remove undesired material to thereby form the individual conductive elements.

The connector circuit 56 can be configured to permit the electrical connection between the first and second terminals 22 and 52 to be verified before the containment shell 50 is fixedly coupled to the initiator 12. In the example provided, the flex circuit 70 is relatively longer than a span between the first and second terminals 22 and 52 so as to provide slack in the flex circuit 70 that permits the containment shell 50 to be separated from the initiator 12 by a distance that permits a tool (e.g., continuity tester) to be coupled to the first terminals 22. As will be appreciated, the slack in the flex circuit 70 also permits the coupling (e.g., soldering) of the flex circuit 70 to either the first terminals 22 or the second terminals 52.

In the example provided, the containment shell 50 can be fixedly coupled to the initiator 12 after the flex circuit 70 is fixedly and electrically coupled to the first and second terminals 22 and 52. For example, the containment shell 50 can be laser welded to the initiator housing 20 to hermetically seal the void space 60.

In the event that the initiator assembly 10 is subjected to a relatively large amount of electrical power over an extended period of time (as is required in the electric cook-off test in MIL-DTL-23659), the initiator assembly 10 may heat in response to receipt of the electric energy and may cause the input charge 26 to cook-off (i.e., decompose, combust or deflagrate). Gases created as the input charge 26 cooks-off may cause failure of one or more of the first seals 36, so that fragments of the initiator 12 and by-products created as the input charge 26 cooks-off are contained in the void space 60. Moreover, the additional volume provided by the void space 60 effectively reduces the internal pressure within the initiator assembly 10 (once one or more of the first seals 36 have failed) so that the risk of failure of the second seals 54 is effectively eliminated.

The containment shell 50 can have a void space 60 that can have a volume that is between 15 cc and 1 cc, such as a volume between 10 cc and 5 cc or 1 cc, or a volume between 5 cc and 1 cc. We have found that sizing the containment shell 50 such that the void space 60 has a volume between 10 cc and 5 cc (e.g., a volume of 5 cc) provides sufficient additional volume to ensure that any gas, fragments or energy that exits the initiator 12 as a result of a failure of one or more of the first seals 36 during cook-off of the input charge 26 remains completely contained in the initiator assembly 10. As will be appreciated, however, the volume of the void space 60 can be tailored to the needs of a specific initiator, which could vary depending on the material used for the input charge 26 and the size of the input charge 26. Additionally, space constraints for packaging the initiator assembly 10 would typically warrant the sizing of the volume of the void space 60 in as small a manner as possible, such as about 1 cc.

Additionally, it may be beneficial in some situations to include electrical insulation on one or more of the internal surfaces in the initiator assembly 10. The electrical insulation may help to prevent grounding between the containment shell 50 and one or more of the second terminals 52, for example. The electrical insulation can comprise one or more insulating materials (e.g., films, sleeves, discs, tapes) that can be mounted to the rear surface 80 of the initiator 12, the inside diameter of the containment shell 50, and any shoulders or end faces of the containment shell 50. In the particular example provided, a unitarily formed insulation shell 82 is mounted within the containment shell 50 and an adhesive tape 84 formed of polyimide (e.g., Kapton®) is mounted to the rear surface 84 of the initiator 12.

Figure 3:
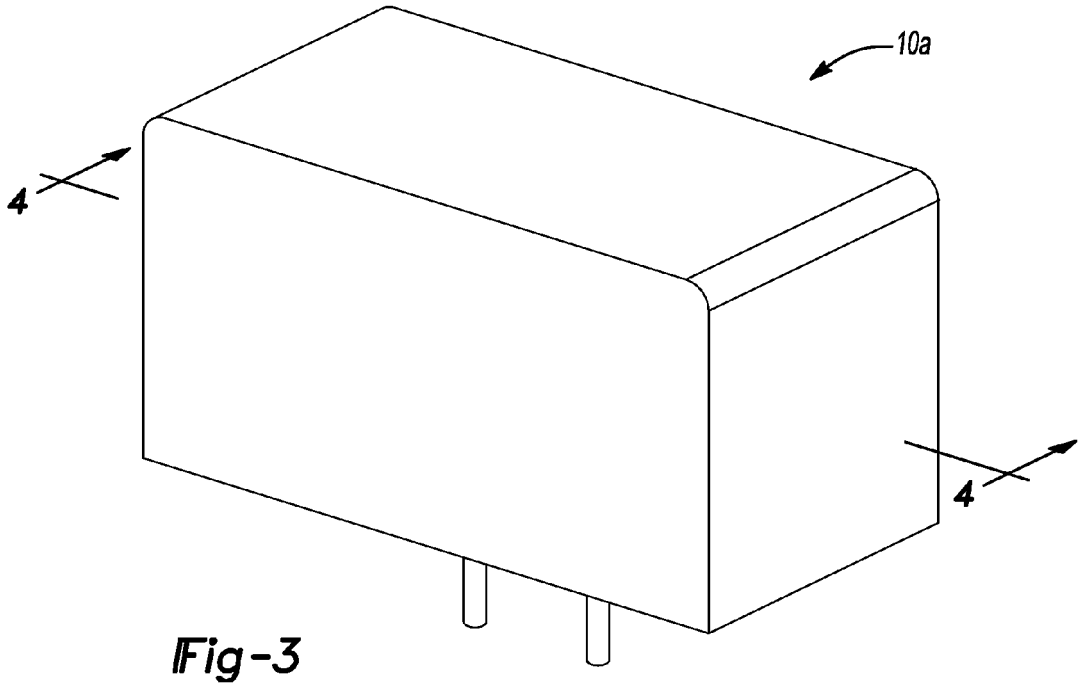
FIG. 3 is a perspective view of a second initiator assembly constructed in accordance with the teachings of the present disclosure.
Figure 4:
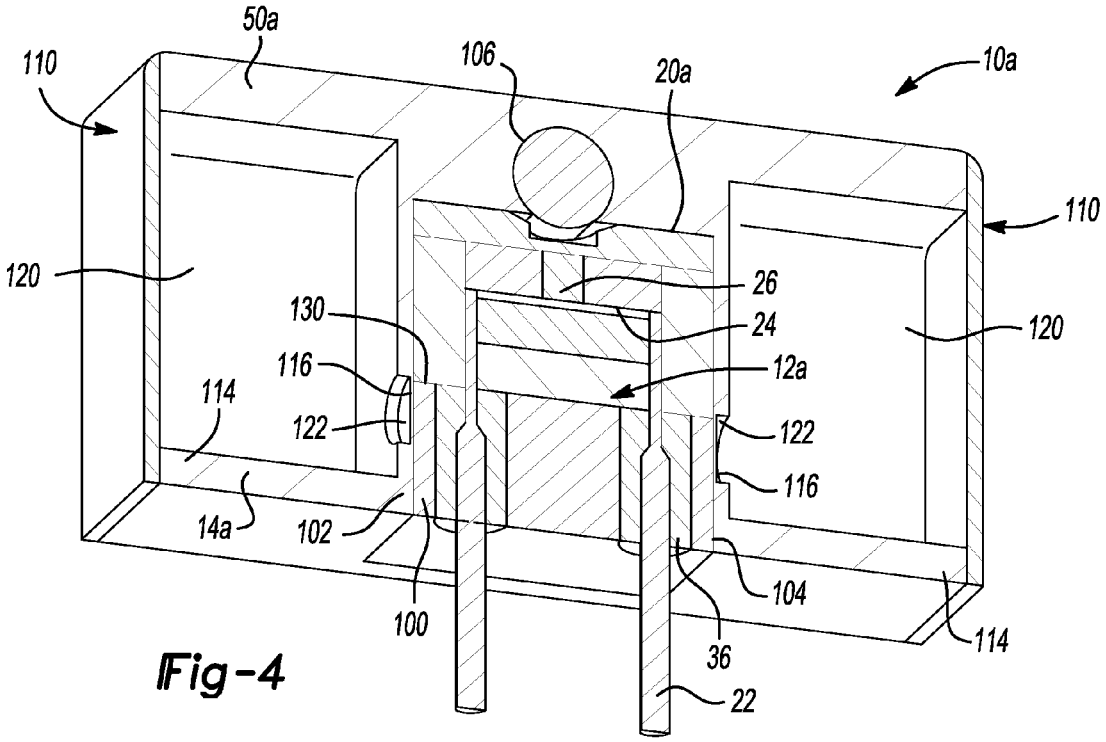
FIG. 4 is a longitudinal section view of the initiator assembly of FIG. 3.

With reference to FIGS. 3 and 4, a second initiator assembly constructed in accordance with the teachings of the present disclosure is generally indicated by reference numeral 10*a*. The initiator assembly 10*a* is generally similar to the initiator assembly 10 of FIGS. 1 and 2, except that a) the initiator 12*a* is configured to produce an output that is discharged perpendicular to the longitudinal axis of the input charge 26, b) the containment structure 14*a* comprises only a containment shell 50*a*, and c) a portion of the containment shell 50*a* is integrally formed with a portion of the initiator housing 20*a*. Those of skill in the art will appreciate that the particular orientation of the output of the initiator assembly 10*a* is merely exemplary and that the orientation may be changed as desired (e.g., to an orientation that is in-line with the longitudinal axis of the input charge 26).

The housing body 30*a* can be formed as two discrete components (i.e., a base structure 100 and a body structure 102) that can be welded together. The first terminals 22, the first seals 36 and the initiator device 24 can be mounted to the base structure 100. The body structure 102 can define a first body bore 104 and a second body bore 106. The first body bore 104 can be configured to receive the base structure 100, the initiator device 24 and the input charge 26, while the second body bore 106 can be configured to receive the output charge 28.

The containment shell 50 can comprise one or more chamber assemblies 110. Each chamber assembly 110 can comprise a chamber 114, a burst disc 116 and a chamber cover 118. Each chamber 114 can be fixedly coupled to (e.g., integrally formed with) the body structure 102. In the particular example provided, each chamber 114 is formed by a chamber bore 120, which is formed into the body structure 102 radially outwardly of the first body bore 104, and a communicating aperture 122 that couples the chamber bore 120 in fluid communication with the first body bore 104. The burst disc 116 can be fitted into the communicating aperture 122 and can be configured to inhibit fluid communication between the chamber bore 120 and the first body bore 104 when a pressure in the first body bore 104 is less than a predetermined pressure. Alternatively, the burst disc 116 can be integrally formed with the body structure 102. The predetermined pressure can be greater than the operational pressure of the initiator 12*a* (i.e., the internal pressure generated when the input charge 26 is initiated by activation of the initiator device 24) but less than the pressure that is required to cause failure of the first seals 36. The chamber cover 118 can be welded to the chamber 114 to close (i.e., hermetically seal) the chamber bore 120 on a side of the chamber 114 that is opposite to the communicating aperture 122.

While the communicating apertures 122 are depicted as being positioned proximate the inside edge 130 of the base structure 100, it will be appreciated that the communicating apertures 122 can be positioned in any desired location so long as the burst discs 116 are exposed to the gas pressure generated when the input charge 26 cooks-off.

In the event that the input charge 26 cooks-off, gas pressure generated by the input charge 26 can cause the burst discs 116 to fail (e.g., burst) to couple one or more of the chamber bores 120 with the first body bore 104. As the pressure at which the burst discs 116 fail is lower than the pressure required to cause failure of the first seals 36, no fragments of the initiator 12*a* or by-products produced by the input charge 26 as it cooks-off are discharged from the initiator assembly 10*a*.

Figure 5:
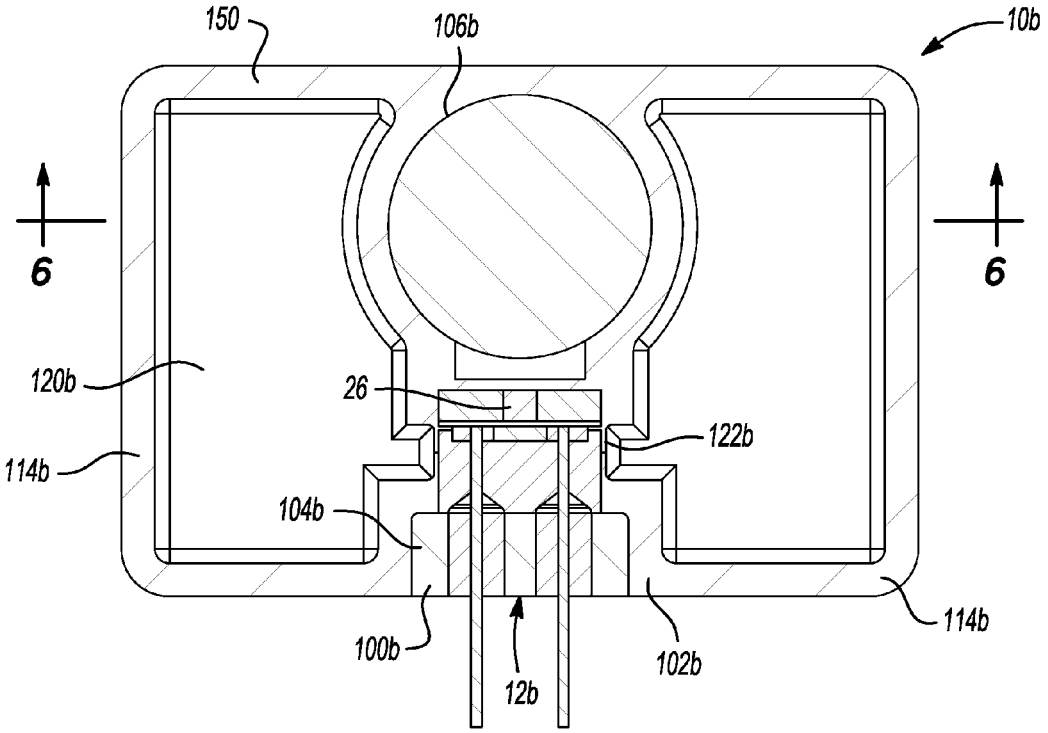
FIG. 5 is a longitudinal section view of a third initiator assembly constructed in accordance with the teachings of the present disclosure'
Figure 6:
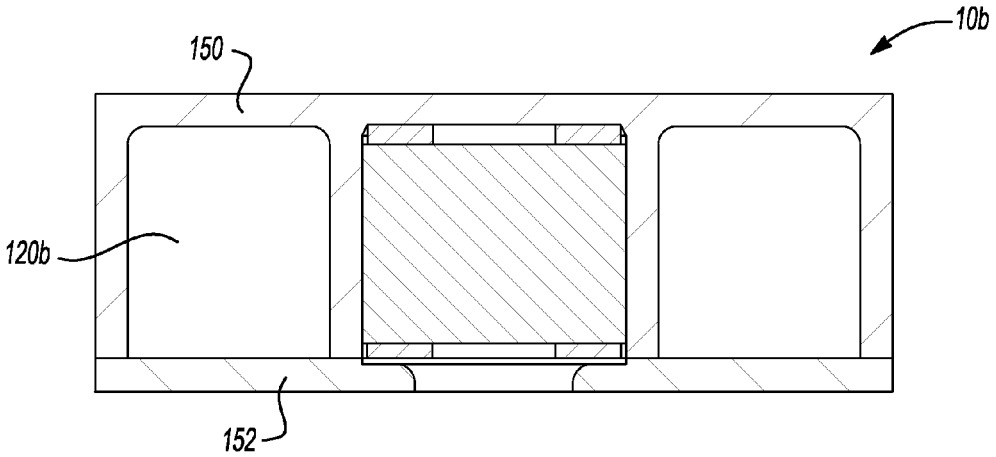
FIG. 6 is a section view taken along the line 6-6 of FIG. 5

The example of FIGS. 5 and 6 is generally similar to the example of FIGS. 3 and 4, except that the body structure 102*b* and the chambers 114*b* are formed in two pieces and the burst discs are eliminated. More specifically, the chambers 114*b* and the body structure 102*b* can be defined by a housing structure 150 and a cover plate 152. The housing structure 150 can be milled, cast or molded, for example, to define various pockets that correspond to the first body bore 104*b*, the second body bore 106*b*, the chamber bores 120*b*, and optionally the communicating apertures 122*b*. Alternatively, the communicating apertures 122*b* can be drilled through the material that is disposed between the chamber bores 120*b* and the first body bore 104*b*. The cover plate 152 can be welded to the housing structure 150 to close the pockets so that only the first and second body bores 104*b* and 106*b* remain open (i.e., for receipt of the base structure 100*b* and the internal components of the initiator 12*b*.

In the event that the input charge 26 cooks-off, gas pressure generated by the input charge 26 is transmitted through the communicating apertures 122*b* from the first body bore 104*b* to the chamber bores 120*b* and no by-products produced by the input charge 26 as it cooks-off are discharged from the initiator assembly 10*b*.

Figure 7:
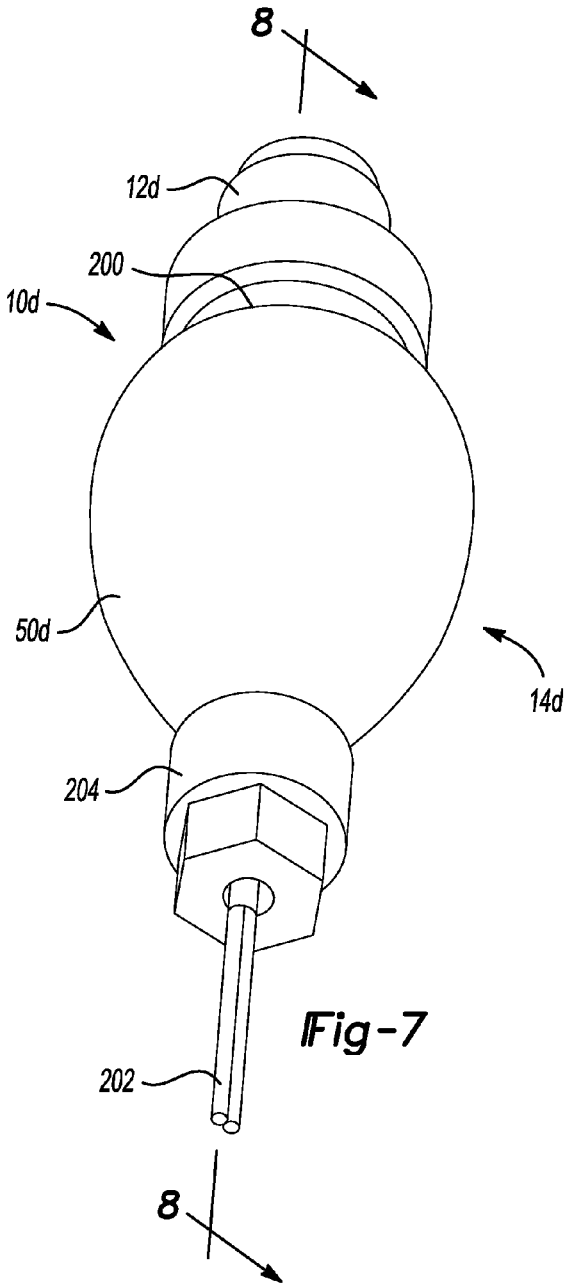
FIG. 7 is a perspective view of a fourth initiator assembly constructed in accordance with the teachings of the present disclosure.
Figure 8:
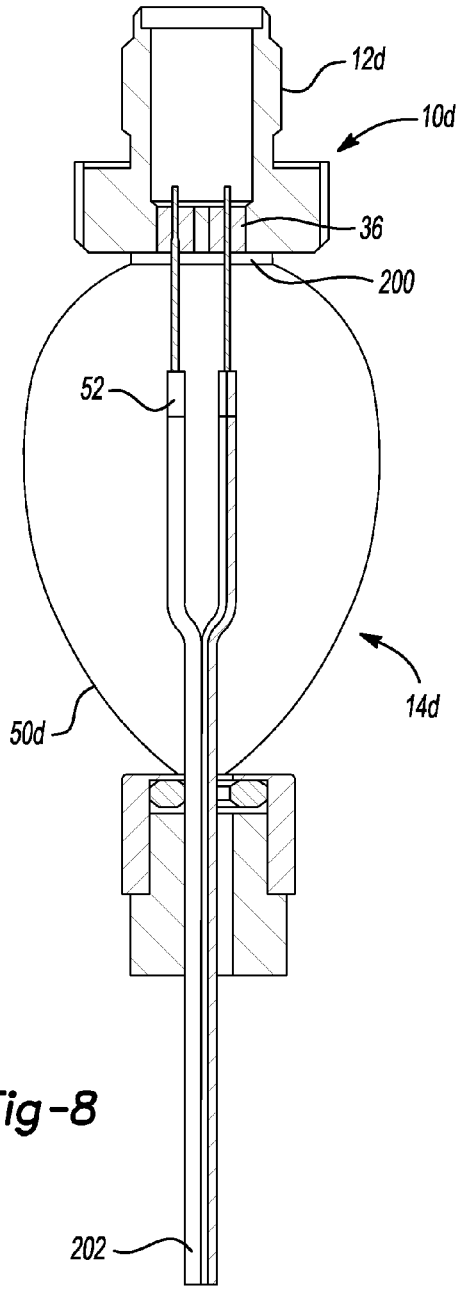
FIG. 8 is a longitudinal section view of the initiator assembly of FIG. 7.

With reference to FIGS. 7 and 8, a fourth initiator assembly constructed in accordance with the teachings of the present disclosure is generally indicated by reference numeral 10*d*. The initiator assembly 10*d* can comprise an initiator 12*d*, which can be generally similar to the initiator 12 of FIGS. 1 and 2, and a containment structure 14*d* having a containment shell 50*d*, a first ferrule 200, a plurality of second terminals 52, a wire cable 202 and a second ferrule 204. The containment shell 50*d* can be formed of a material and/or in a manner that permits the containment shell 50*d* to expand. In the particular example provided, the containment shell 50*d* is an expandable bag that is formed of a suitable material, such as aramid fiber (e.g., KEVLAR®). The first ferrule 200 can couple a first end of the containment shell 50*d* to the rear surface of the initiator 12*d*. The second terminals 52 can couple the first terminals 22 to corresponding conductors in the wire cable 202. The wire cable 202 can extend through the containment shell 50*d* and can be configured to couple to a fire set for activating the initiator 12*d*. The second ferrule 204 can couple the second end of the containment shell 50 to the wire cable 202.

In the event that the input charge (not specifically shown) cooks-off, gas pressure generated by the input charge can cause failure of one or more of the first seals 36. Fragments of the initiator 12*d*, along with by-products produced when the input charge cooks-off are contained in the containment shell 50*d*, which can expand as necessary to ensure that no by-products produced by the input charge as it cooks-off or initiator fragments are discharged from the initiator assembly 10*d*.

Figure 9:
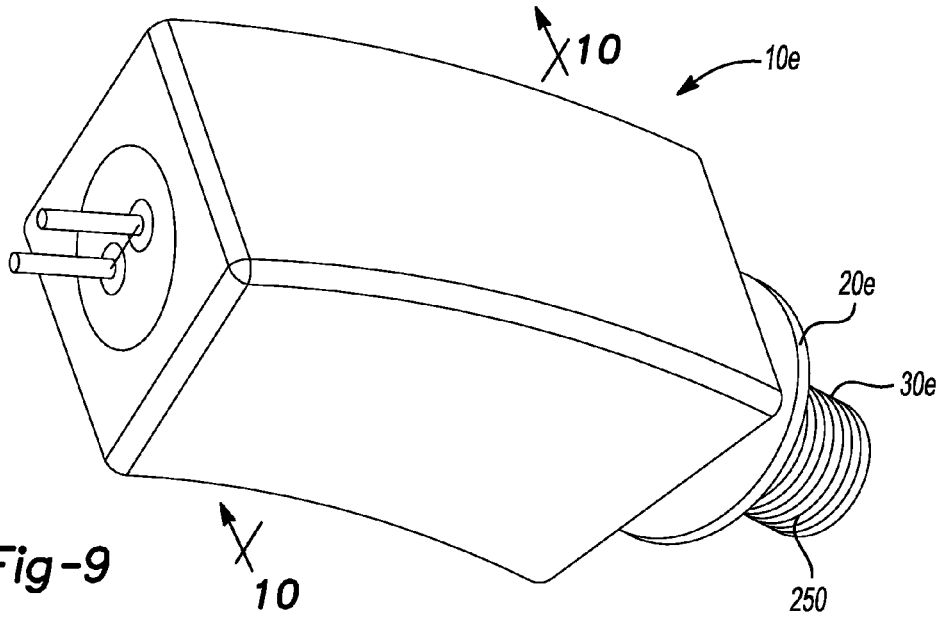
FIG. 9 is a perspective view of a fifth initiator assembly constructed in accordance with the teachings of the present disclosure.
Figure 10:
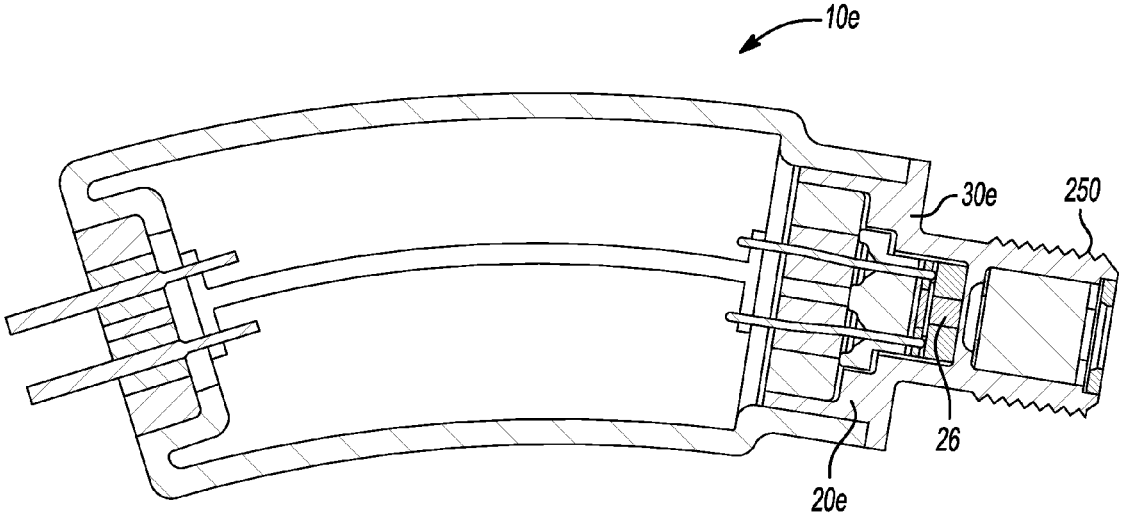
FIG. 10 is a longitudinal section view of the initiator assembly of FIG. 9.

With reference to FIGS. 9 and 10, a fifth initiator assembly constructed in accordance with the teachings of the present disclosure is generally indicated by reference numeral 10*e*. The initiator assembly 10*e* is generally similar to the initiator assembly 10 of FIGS. 1 and 2, except that the housing body 30*e* of the initiator housing 20*e* has a threaded portion 250 that is configured to be mounted in the wall (not shown) of a container that stores a fuel propellant (rather than within the fuel propellant itself). As in the example of FIGS. 1 and 2, the containment shell 50*e* is configured to fit within available space in the device to which the initiator assembly 10*e* is mounted. It will be appreciated that an in-wall mounting configuration of the initiator assembly 10*e* eliminates issues with the venting of the initiator assembly into the propellant of a motor. Configuration of the initiator assembly in this manner may be desirable when through-wall initiation is permissible and it would be undesirable to discharge initiator fragments and/or by-products produced if the input charge 26 of the initiator assembly 10*e* should cook-off into a space in which the initiator assembly 10*e* is mounted (typically an environment with electronics that may be react poorly to introduction of gases or fragments into the environment).

Figure 11:
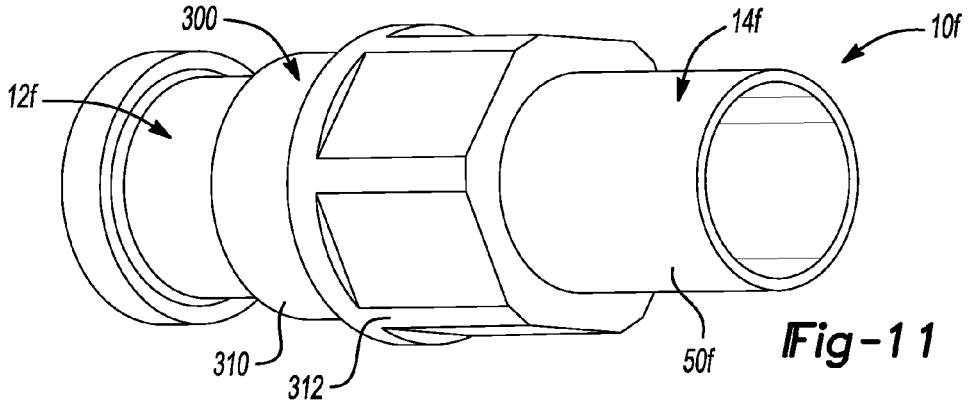
FIG. 11 is a perspective view of a sixth initiator assembly constructed in accordance with the teachings of the present disclosure.
Figure 12:
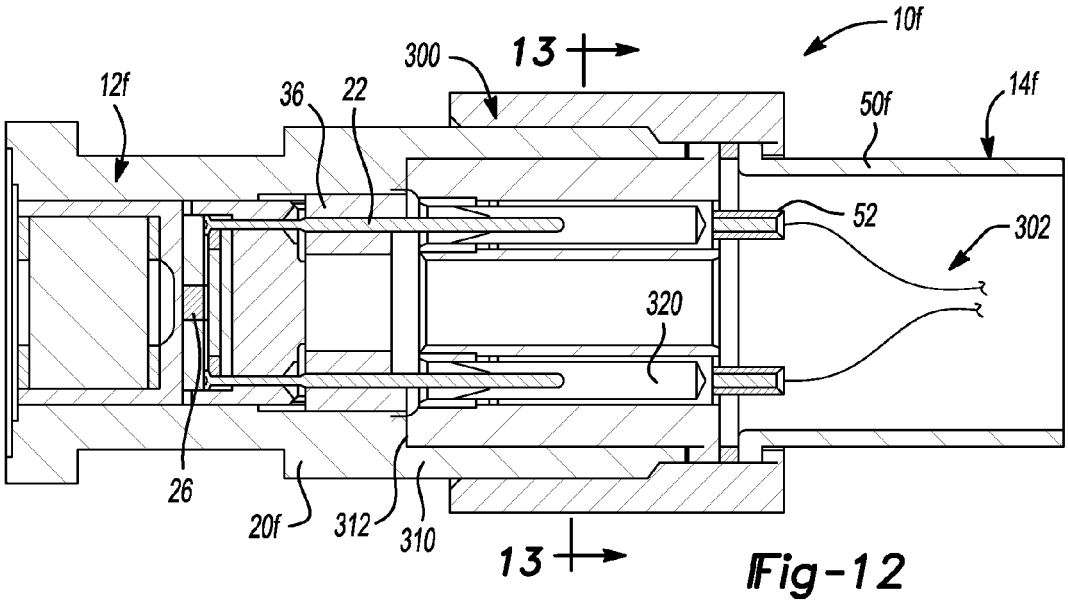
FIG. 12 is a longitudinal section view of the initiator assembly of FIG. 11.
Figure 13:
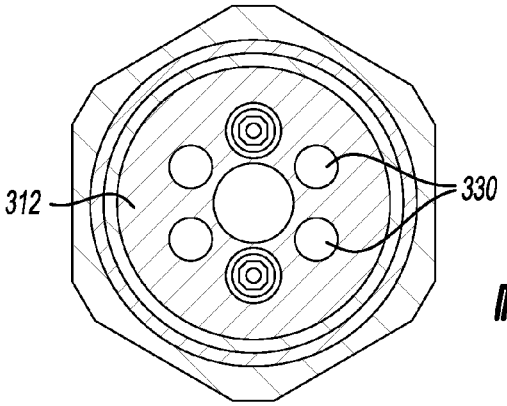
FIG. 13 is a section view taken along the line 13-13 of FIG. 12.

With reference to FIGS. 11 through 13, a sixth initiator assembly constructed in accordance with the teachings of the present disclosure is generally indicated by reference numeral 10*f*. The initiator assembly 10*f* can comprise an initiator 12*f*, a containment structure 14*f* and a connector interface 300. The initiator 12*f* can be generally similar to the initiator 12 of FIGS. 1 and 2. The containment structure 14*f* can comprise a containment shell 50*f*, a plurality of second terminals 52, and a wire harness 302. The containment shell 50*f* can be a generally tubular structure that can surround the wire harness 302. The containment shell 50*f* can be configured to contain any fragments and energy that are generated by the initiator 12*f* if the input charge 26 cooks-off, and can direct gas produced by the input charge 26 as it cooks-off to a desired area that can be located remotely from the propellant of the motor.

The connector interface 300 can be configured to fixedly and sealingly couple the initiator 12*f* to the containment structure 14*f* and can comprise a first connector portion 310 and a second connector portion 312. The first connector portion 310 can be fixed to the initiator housing 20*f*. In the particular example provided, the first connector portion 310 is integrally formed with the initiator housing 20*f*. The second connector portion 312 can be fixedly and sealingly coupled to the containment shell 50*f*. The second connector portion 312 can have a plurality of third terminals 320, which can matingly engage the first terminals 22 and the second terminals 52 to thereby electrically couple the first terminals 22 to the wire harness 302. The second connector portion 312 can define a plurality of vent apertures 330 that couple at least one of the first connector portion 310 and the initiator housing 20*f* in fluid connection with the containment shell 50*f*.

In the event that the input charge 26 cooks-off, gas pressure generated by the input charge 26 can cause failure of one or more of the first seals 36. Relatively large fragments of the initiator 12*f* (i.e., fragments that are too large to fit through the vent apertures 330 in the second connector portion 312) can be contained between the initiator housing 20*f* and the containment structure 14*f*, whereas smaller fragments of the initiator 12*f*, along with by-products produced when the input charge 26 cooks-off can be transmitted through the vent apertures 330 into the containment shell 50*f* where they can be directed to a desired area should they flow out of the distal end of the open containment structure 14*f*.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An initiator assembly comprising:

an initiator having an input charge that is formed of an energetic material, the initiator being configured to initiate a detonation event in the input charge; and a containment shell coupled to the initiator, the containment shell defining a space into which gas and/or particles are ejected from the initiator if the initiator is not activated and the input charge is cooked off, the containment shell being configured such that the gas and/or the fragments produced when the input charge is cooked off is/are contained substantially permanently within the initiator assembly.

2. The initiator assembly of claim 1, wherein the initiator comprises an initiator housing and a plurality of first terminals that extend through the initiator housing.

3. The initiator assembly of claim 2, further comprising a plurality of second terminals that extend through the containment shell, the second terminals being electrically coupled to the first terminals.

4. The initiator assembly of claim 3, wherein the second terminals are sealed to the containment shell.

5. The initiator assembly of claim 3, wherein a flex circuit couples the first terminals to the second terminals.

6. The initiator assembly of claim 1, wherein the initiator includes an initiator housing and wherein the containment shell and the initiator housing are integrally formed.

7. The initiator assembly of claim 1, wherein the containment shell comprises an inflatable bladder.

8. The initiator assembly of claim 1, wherein the initiator includes an initiator housing and wherein a portion of the initiator housing is threaded.

9. The initiator assembly of claim 1, wherein the initiator includes an initiator housing, and wherein the initiator housing and the containment shell couple to one another through a connector interface, the connector interface comprising a first connector portion and a second connector portion, the first connector portion being fixed to the initiator housing, the second connector portion being coupled to the containment shell, the second connector portion having a plurality of second terminals, which matingly engage the first terminals, and a plurality of vent apertures that couple at least one of the first connector portion and the initiator housing in fluid connection with the containment shell.

10. An initiator assembly comprising:

an initiator having an input charge that is formed of an energetic material, the initiator being configured to initiate a detonation event in the input charge; and a containment shell coupled to the initiator, the containment shell defining a space into which gas and/or particles are ejected from the initiator if the initiator is not activated and the input charge is cooked off, the space being sized such that the gas and/or the fragments produced when the input charge is cooked off is/are substantially permanently contained within the initiator assembly.

11. The initiator assembly of claim 10, wherein the space has a volume that is less than or equal to 15 cc but greater than or equal to 1 cc.

12. The initiator assembly of claim 11, wherein the volume of the space is less than or equal to 10 cc.

13. The initiator assembly of claim 12, wherein the volume of the space is less than or equal to 5 cc.

14. The initiator assembly of claim 10, wherein the initiator further comprises an initiator housing and a set of first terminals, and wherein the containment shell comprises a set of second terminals and a connector circuit, the set of first terminals extending through the initiator, the set of second terminals extending through the containment housing, the connector circuit coupling each of the second terminals to a corresponding one of the first terminals.

15. The initiator assembly of claim 14, wherein the connector circuit has an inductance of less than 250 nH when power that is configured to cause the initiator device to operate is transmitted through the connector circuit.

16. The initiator assembly of claim 15, wherein the inductance of the connector circuit is less than or equal to 50 nH.

17. The initiator assembly of claim 16, wherein the inductance of the connector circuit is less than or equal to 30 nH.

18. The initiator assembly of claim 14, wherein the connector circuit is a flex circuit.

19. The initiator assembly of claim 10, further comprising an insulator coupled to at least one surface that bounds the space.

20. The initiator assembly of claim 19, wherein the insulator comprises a shell that is mounted within the containment shell.

21. The initiator assembly of claim 19, wherein the insulator comprises an electrically insulating material that is mounted to a surface of the initiator.

22. An initiator assembly comprising:

an initiator having an input charge that is formed of an energetic material, the initiator being configured to initiate a detonation event in the input charge; and means for substantially permanently containing gas and particles that are ejected from the initiator when the input charge is destroyed in an event that does not include detonation of the input charge.

* * * * *